US005777540A

United States Patent [19]

Dedert et al.

[11] Patent Number: 5,777,540

[45] Date of Patent: Jul. 7, 1998

[54] ENCAPSULATED FUSE HAVING A CONDUCTIVE POLYMER AND NON-CURED DEOXIDANT

[75] Inventors: Ronald J. Dedert; Steven J. Hreha, both of Geneva; William A. Hollinger, Jr., Monroe, all of Ind.

[73] Assignee: CTS Corporation, Elkhart, Ind.

[21] Appl. No.: 592,907

[22] Filed: Jan. 29, 1996

[51] Int. Cl.[6] ..... H01H 85/00

[52] U.S. Cl. ..... 337/142; 337/160; 337/290; 337/401; 257/665; 438/601

[58] Field of Search ..... 337/4, 142, 160, 337/260, 268, 270, 290, 401; 257/665; 438/601

[56] References Cited

U.S. PATENT DOCUMENTS 4,796,075 1/1989 Whitten ..... 257/665

5,256,899 10/1993 Rangappan ..... 257/665

5,622,892 4/1997 Bezama et al. ..... 438/601

*Primary Examiner*—Leo P. Picard

*Assistant Examiner*—Jayprakash N. Gandhi

*Attorney, Agent, or Firm*—Michael W. Starkweather; Albert W. Watkins

[57] ABSTRACT

A simplified method of manufacturing an electrothermal fuse includes the steps of screening conductive epoxy onto fuse link termination pads, placing a metal alloy fuse link into the conductive epoxy on the termination pads, curing the conductive epoxy, applying deoxidant, applying encapsulant, and curing the encapsulant. The resultant fuse of the preferred embodiment comprises a substrate, termination pads, conductive epoxy interconnects, a solder type fuse link, liquid deoxidant and encapsulant.

6 Claims, 3 Drawing Sheets

ENCAPSULATED FUSE HAVING A CONDUCTIVE POLYMER AND NON-CURED DEOXIDANT

BACKGROUND OF THE INVENTION

1. Field of the Invention

This invention pertains generally to electrical fuses, and particularly to methods for making thermoelectric fuses.

2. Description of the Related Art

Electricity is an extremely useful form of energy. With electricity people can generate motion, heat, light, sound, moving pictures, communications around the world, and even complex computations. These extraordinary accomplishments are attained through careful control and regulation. Absent such control, electricity can be extremely potent.

Unfortunately, in nature as well as in man-made circuits, we occasionally are unable to control and regulate electricity. For example, lightening strikes represent incredible discharges of energy beyond our normal control. The strikes are very destructive to standard devices used to control electricity. There are also occasions where wires may get crossed or one or more components fail destructively. Each of these events may not be preventable.

Understandably, there has for a long time been a desire to protect against extreme electrical events, such as lightening strikes and power surges. Also not surprisingly, this desire is not new. As might be expected, a whole body of technology has developed around protective devices.

There are thermal fuses, mechanical fuses, spark gap surge arrestors, varistors, and other similar devices, each designed specifically as a solution to one or more extreme electrical events. Each device provides benefit in particular situations that may be greater than other types of devices. As a result, a designer of an electrical circuit must evaluate the requirements of the system and assess where a given device will be most suitable. Even within these broader categories of overload circuit protectors, different designs yield widely varying performances.

In view of the increasing prevalence of electrical devices in modern society, more people are seeking better ways to control and protect against otherwise destructive electricity. As with most products, there is a cost and performance assessment which must be made by each circuit designer in selecting the particular components which will be best for a given circuit. Given the importance of cost in the marketplace, and yet the risk associated with inadequate designs, advancements in this art have become increasingly more difficult.

One of the more common types of fuses is the electrothermal fuse. In the electrothermal fuse, electrical current flowing through the fuse causes the fuse to heat. In normal operation, the temperature of the device remains relatively low and, likewise, the resistance of the device also remains low. When an overload current flows through the device, the internal temperature of the fuse rises sufficiently to cause the fuse to electrically open.

Many of these electrothermal fuses are manufactured from a relatively small diameter or cross-section metallic conductor which is connected in series with other electrical conductors or devices. As electrical current flows through the small diameter conductor, the thermal energy dissipated is equal to the resistance in the conductor multiplied by the square of the current flowing through the conductor. The power dissipated increases as the square of the current, meaning that at some fairly well defined level of current, the metallic conductor will melt. As the conductor melts, given a properly designed fuse, the conductor will physically separate from itself or from terminations connected to it, thereby opening the circuit.

The design of the metallic conductor, the terminations, and protective encapsulants or housings are all critical to the proper operation of an electrothermal fuse. When properly designed, the electrothermal fuse can be a very effective circuit protector from both a performance and also cost perspective. However, even small changes or deviations from one design to another can affect the performance of the device.

One of the common types of electrothermal fuses uses a solder link to bridge between termination pads. The termination pads may be metallic in nature, for example silver, or may be a glass or ceramic and metal glaze commonly referred to as a cermet. Various alternatives are known in the art for the types of solder as well as the exact compositions of the termination pads. Generally, the solder is attached to the pads by either direct application of heat or energy to the solder link to cause it to melt and flow onto the pads, or by application of heat to the terminations. Sometimes, when heat is applied to the terminations, a solder paste which includes metallic solder powder and a fluxing agent is applied to the terminations prior to heating. The solder paste will then be reflowed, forming a metallurgical bond between the termination pads and the solder link without directly melting the bulk of the solder link.

When solder is used as the fusing material, there are several issues that must be addressed carefully in designing the fuse. One issue is environmental durability, and another is ensuring actual separation of the link upon melting. In the prior art, designers of fuse links typically design termination pads of relatively large dimension relative to the solder link. The termination pads are coated with a thin layer of solder or solder paste, and the solder link attached. The theory behind the design is that the solder link, upon melting, is drawn by surface tension to the termination pads. In moving to the terminations, the link is thereby divided and separated by an adequate distance to prevent later reconnection or arcing. Sometimes, multiple layers are applied to form either the link or the terminations, where the allotted cost allows a more elaborate fuse structure.

Protection of the link against environmental degradation, such as oxidation, is typically achieved through the application of a deoxidant material. The deoxidant is often applied directly onto the fuse, generally surrounding any open surfaces of the link. When the fuse is exposed to harsh environmental conditions, the deoxidant selectively oxidizes, thereby protecting the solder link from oxidation.

Further protection of the link is typically achieved by encapsulating the link and the deoxidant in some type of housing or encapsulant. The housing may take the form of a much larger tube surrounding the link, or may simply be a coating applied directly over the top of the deoxidant where the fuse link is attached to a flat substrate. Sometimes a cover or cap may be applied over the link and deoxidant, to act as an environmental barrier.

FIG. 1 illustrates a prior art fuse assembly method. The first step 100 in the prior art method is screening solder paste onto termination pads located on a substrate or support. The screened solder paste is heated to reflow in step 105, and then an additional layer of solder paste is screened at step 110. The two screening steps 100 and 110 are necessary to ensure adequate wetting of the terminations, which typically will require some combination of higher time and/or temperature than the fuse link would be exposed to. Alternatively, two different melting point solder pastes might be used, typically a higher melt alloy for the termination pad and a lower melt alloy to bond the solder link to the termination pad.

Once the second layer of solder paste is screened at step 110, the fuse is placed at step 115. In step 120, the fuse and second layer of solder paste will be reflowed at the terminations. The selective reflow of step 120 may typically be accomplished either through the application of a hot iron such as a hot bar or soldering iron, or through the application of laser energy or a focussed hot air stream.

Any remaining solder flux will need to be removed through a wash at step 125. Deoxidant is applied over the fuse link in step 130, and the deoxidant is then cured at step 135. In order to ensure environmental integrity, a second application of deoxidant followed by curing is required as shown in steps 140 and 145. An adhesive is then applied in step 150, and a lid placed over the fuse link and surrounding deoxidant and adhesive in step 155. The adhesive is then cured as shown in step 160. Finally, any surrounding components such as resistors or capacitors which might have been trimmed are encapsulated at step 165, and the encapsulant is cured as shown in step 170. As is apparent, these fifteen steps required to apply and seal a solder type fuse link in the prior art are cumbersome, expensive, and, as with all manufacturing processes, prone to higher losses in total yield with increasing numbers of operations.

SUMMARY OF THE INVENTION

In the present invention, a method of making a fuse includes the steps of screening conductive polymer onto terminations, placing a metal fuse link between the terminations, curing the conductive polymer, applying a deoxidant, applying an encapsulant, and curing the encapsulant.

The fuse according to the present invention has two termination pads, a fuse link extending between the termination pads and attached thereto by conductive polymer, an encapsulant surrounding the fuse link and a liquid deoxidant, where the liquid deoxidant forms a chamber surrounding the fuse link within the encapsulant.

OBJECTS OF THE INVENTION

A first object of the invention is to reduce the number of manufacturing steps required to produce a reliable solder type fuse link. A second object of the invention is to improve the manufacturing yield during production of a solder type fuse link. A third object of the invention is to produce an environmentally sound solder type fuse link. These and other objects of the invention are best accomplished as described hereinbelow in reference to the preferred embodiment. The scope of the invention is set forth in the claims appended hereto.

DESCRIPTION OF THE PREFERRED EMBODIMENT

Figure 2:
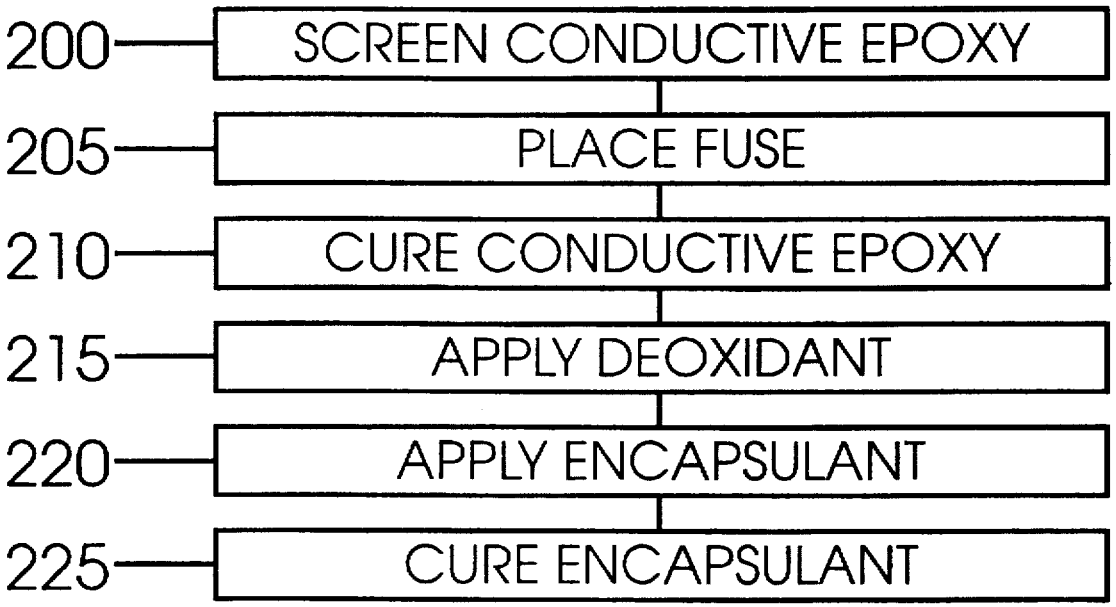
FIG. 2 illustrates the preferred embodiment of the assembly method according to the invention.
Figure 3:
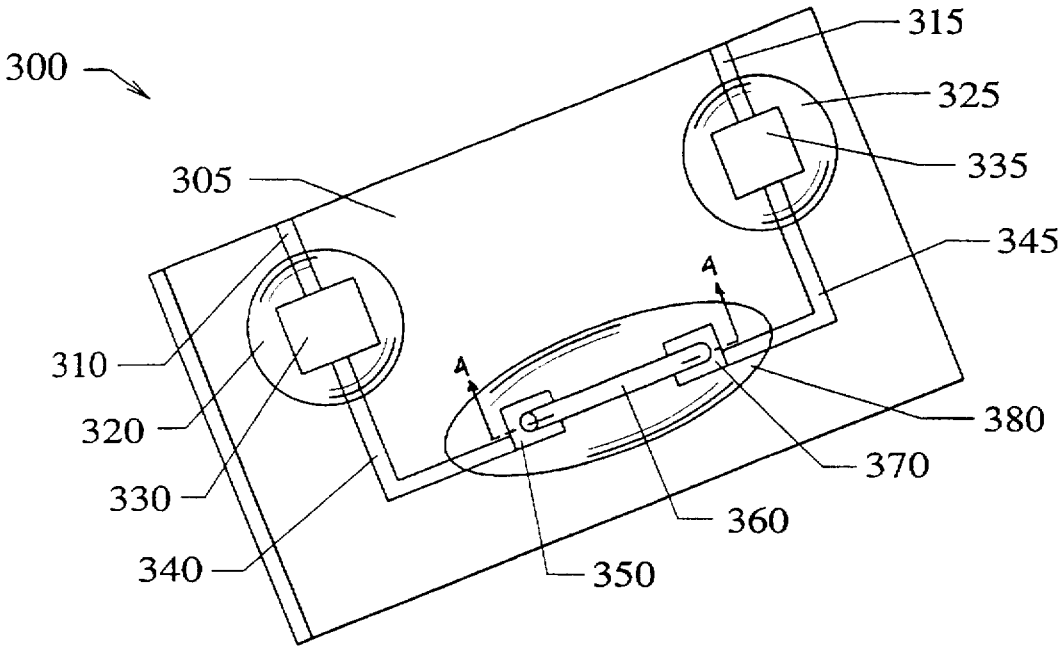
FIG. 3 illustrates a projection view of a fuse and neighboring circuitry assembled using the preferred method of the present invention.
Figure 4:
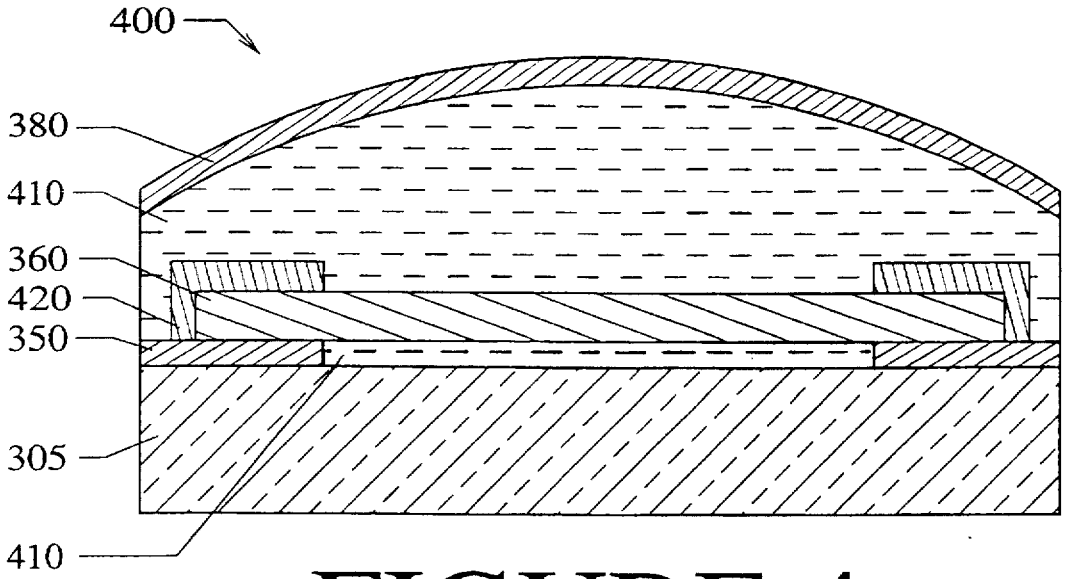
FIG. 4 illustrates a cut-away cross section of the fuse of FIG. 3.

FIGS. 2–4 illustrate the preferred embodiments of the present invention. Therein a fuse and assembly method are illustrated. The assembly method of the present invention includes in step 200 screen printing conductive epoxy 420 onto fuse termination pads 350 and 370. Termination pads 350 and 370 are illustrated herein in the preferred embodiment as being metallic pads on a glass or ceramic substrate 305. However, one of ordinary skill will recognize that a variety of substrate materials and termination pad compositions will be very suited to the teachings of the present invention. Furthermore, while conductive epoxy 420 is shown, one of ordinary skill in the art will recognize that other filled or intrinsically conductive polymers can similarly be used to form the interconnection between fuse link 360 and terminations 350 and 370.

The use of a conductive polymer type bond is novel in this application, since, in the prior art, termination pads 350 and 370 were depended upon to wick solder link 360, when link 360 melted. Polymer materials, however, are notorious for not wetting well by solder. As will be explained further, the present invention does not depend upon the usual wicking, thereby allowing the inventors the benefit of a less complex, lower temperature interconnect between link 360 and terminations 350 and 370.

In step 205, fuse link 360 is placed between termination pads 350 and 370, and pressed into the conductive epoxy 420. As best illustrated in FIG. 4, conductive epoxy 420 will then surround the ends of fuse link 360, thereby ensuring a reliable bond and electrical interconnection.

Once fuse link 360 is placed, conductive epoxy 420 is cured as shown in step 210. Typical conductive epoxies cure at a temperature of 125–150 degrees Centigrade, which is well below the melting point of tin-lead solders. Therefore, the curing process has no adverse affect upon fuse link 360.

Following the curing step 210, a deoxidant is applied in step 215. In the preferred embodiment, this deoxidant is a high viscosity liquid in a gel or paste form and one which remains liquid, such as SP-273 available from Kester Solder located in Des Plaines, Ill. Adipic acid may be added at levels, for example, of 15%. The particular deoxidant selected and the subsequent process is critical for the successful performance of the fuse. The inventors have found that a typical cured deoxidant will form a relatively rigid straw-like structure around the fuse link, and the fuse will not open up reliably during overload conditions. The use of a liquid deoxidant, which is not subsequently cured, results in the formation of a chamber-like structure within encapsulant 380, when link 360 heats up and the viscosity and volume of deoxidant 410 are reduced. When link 360 melts, surface tension causes link 360 to divide into several more rounded pools of molten metal. So long as deoxidant 410 remains fluid, link 360 will be allowed to pool. However, and this point is critical, the use of a deoxidant which restricts link 360 from pooling or otherwise changing shape will result in failure of the fuse to operate properly.

Once deoxidant 410 is applied, an encapsulant 380 is applied in step 220. The inventors have discovered that an encapsulant used for encapsulating discrete components such as resistors and capacitors after laser scribing is also an effective encapsulant for fuse link 360. The preferred encapsulant is a solventless silicone conformal coating, part number 3-01744 available from Dow Corning located in Midland, Mich. This particular encapsulant is clear, which allows for visual inspection of the fuse. Additionally, there is no need for elevated processing temperatures, thereby preserving the state of deoxidant 410 and link 360.

The final step in the process, step 225, is the curing of encapsulant 380. As already noted, this will preferably be done without the use of elevated temperatures, and with an encapsulant material that generates a minimum of byproducts during cure.

Figure 1:
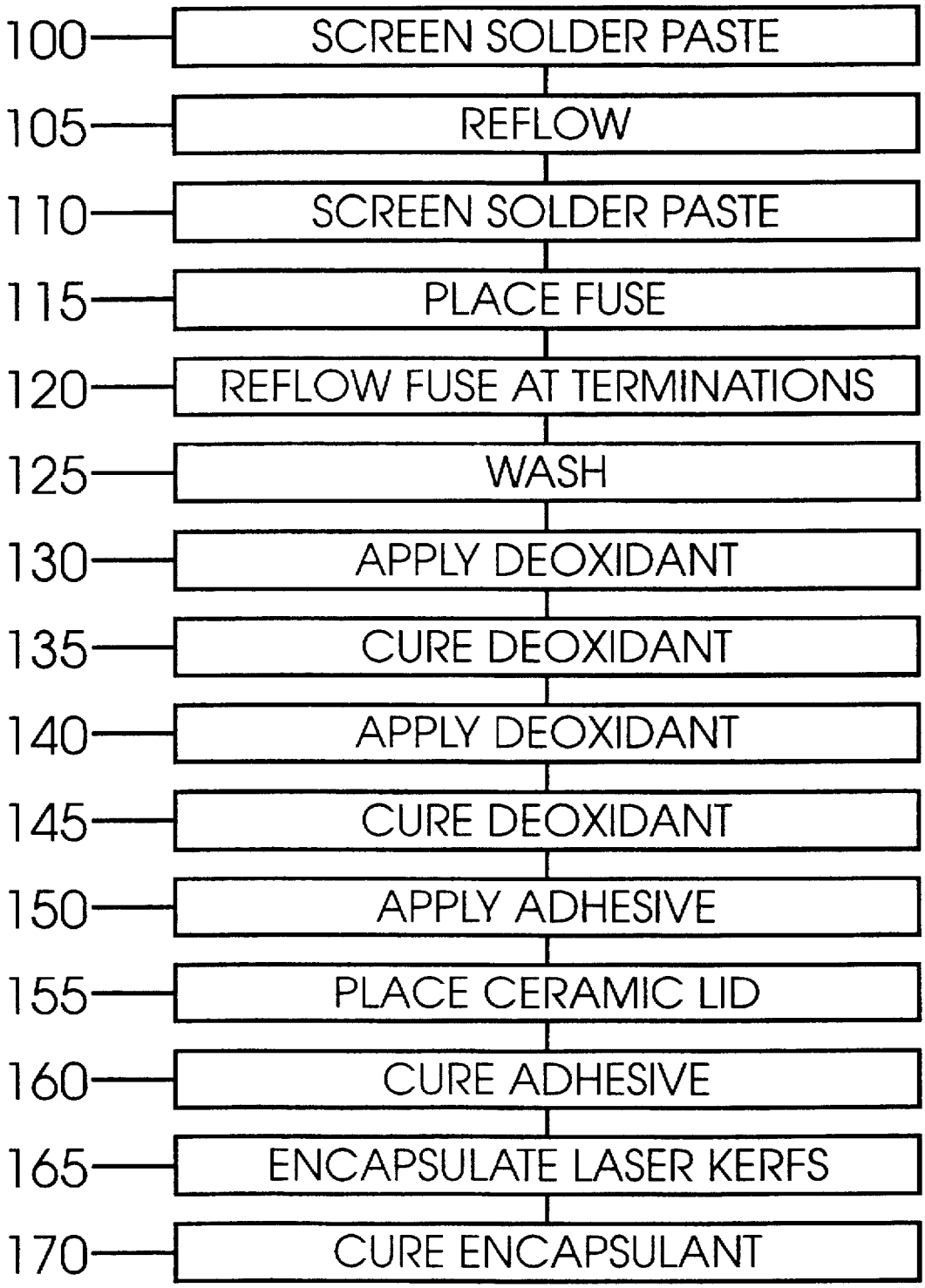
FIGURE 1 (PRIOR ART)
FIG. 1 illustrates a prior art assembly method for attaching solder type fuse links to termination pads upon a substrate.

As a result of the simplified method of manufacture, step 220 of applying encapsulant 380 may sometimes be a dual-function step. In those instances where additional components 330 and 335 share substrate 305 with fuse link 360, those components 300 and 335 may simultaneously be encapsulated. This is best illustrated in FIG. 3, wherein encapsulant 320 encapsulates device 330 and encapsulant 325 encapsulates device 335. As noted hereinabove in reference to the prior art of FIG. 1, encapsulating additional laser kerfs and curing the encapsulant required the two additional steps 165 and 170.

As shown, electrical conductors 310, 315, 340 and 345 may be used to interconnect various electrical devices. While the foregoing details what is felt to be the preferred embodiment of the invention, no material limitations to the scope of the claimed invention is intended. Further, features and design alternatives that would be obvious to one of ordinary skill in the art are considered to be incorporated herein. The scope of the invention is set forth and particularly described in the claims hereinbelow.

We claim:

1. An electrothermal fusing circuit comprising:

two terminations;

a meltable fuse link extending between said two terminations;

a conductive polymer interconnecting said two terminations to said meltable fuse link;

a non-cured deoxidant protecting said fuse link from oxidation;

an encapsulant, said encapsulant encapsulating said fuse link and said non-cured deoxidant.

2. The electrothermal fuse of claim 1 further comprising peripheral electrical devices, said peripheral electrical devices also encapsulated by said encapsulant.

3. The electrothermal fusing circuit of claim 1 wherein said meltable fuse link is comprised by a solder alloy.

4. The electrothermal fusing circuit of claim 3 wherein said solder alloy is a tin-lead eutectic.

5. The electrothermal fusing circuit of claim 1 wherein said conductive polymer is comprised by a silver-filled epoxy.

6. The electrothermal fusing circuit of claim 1 wherein said non-cured deoxidant is a liquid.

* * * * *